United States Patent [19]

Juhola

[11] 4,455,105

[45] Jun. 19, 1984

[54] PROCEDURE AND MEANS FOR CREATING A VERTICAL DRAIN

[76] Inventor: Mauno O. Juhola, Lounaisväylä 2, 00200 Helsinki 20, Finland

[21] Appl. No.: 346,053

[22] PCT Filed: May 21, 1981

[86] PCT No.: PCT/FI81/00035

§ 371 Date: Jan. 20, 1982

§ 102(e) Date: Oct. 20, 1982

[87] PCT Pub. No.: WO81/03354

PCT Pub. Date: Nov. 26, 1981

[30] Foreign Application Priority Data

May 22, 1981 [FI] Finland ..... 801657

[51] Int. Cl.[3] ..... E02B 11/00

[52] U.S. Cl. ..... 405/50; 83/444; 83/639; 405/36

[58] Field of Search ..... 405/50, 36, 37; 83/440.1, 444, 639, 580, 649

[56] References Cited

U.S. PATENT DOCUMENTS

| | | | |
|---|---|---|---|
| 3,300,987 | 1/1967 | Maeda | 405/50 |
| 3,624,720 | 11/1971 | Laky | 83/639 X |
| 3,648,632 | 3/1972 | Miller | 83/444 X |
| 3,799,016 | 3/1974 | McYaugh | 83/444 X |
| 3,811,348 | 5/1974 | Brown | 83/639 X |
| 3,815,464 | 6/1974 | Frost | 83/639 |
| 4,016,728 | 4/1977 | Mason | 405/190 |
| 4,166,508 | 9/1979 | Berg | 405/50 X |

FOREIGN PATENT DOCUMENTS

| | | | |
|---|---|---|---|
| 7707303 | 1/1979 | Netherlands | 405/50 |
| 7811388 | 5/1980 | Netherlands | 405/50 |

*Primary Examiner*—Dennis L. Taylor

[57] ABSTRACT

A procedure for creating a vertical drain by pushing into the ground an insertion tube (7) housing within itself a so-called prefabricated drain (9), by pulling out the insertion tube and cutting off the prefabricated drain. The prefabricated drain is cut off with a cross-cutting means located within the insertion tube (7) at such height, or in such a layer as for instance a sand stratum (3) which accepts the water conveyed by the prefabricated drain.

5 Claims, 5 Drawing Figures

PROCEDURE AND MEANS FOR CREATING A VERTICAL DRAIN

The present invention is applied when using prefabricated drains to the purpose of compacting water-carrying, fine-grained and poorly water-permeable soil, such as clay, silt, etc. by carrying out dewatering of the soil material with the aid of vertical draining and thereby reducing the water content of the soil material. Hereby one improves the bearing capacity of the ground and accelerates the settlings that can be expected to take place, while at the same time the shearing strength of the soil increases.

Various kinds of prefabricated drains have been developed for vertical draining, consisting of a profiled strip e.g. of plastic with about 10 cm width, and of porous paper or another similar, draining material wound around it which is permeable to water.

A prefabricated drain is installed in the ground by pushing it with the aid of a special insertion tube to desired depth, usually in vertical direction. The prefabricated drain is held in the insertion tube, and the lower end of the prefabricated drain becomes anchored in position with the aid of a special anchoring member. The insertion tube is pulled out on completed installation, thus leaving the vertical prefabricated drain in the ground. The prefabricated drain is cut off a short distance over the ground surface. Such prefabricated drains are provided at a suitable spacing depending on the ground conditions and on the objective in mind, e.g. with 1-2 m spacing, in the area which one desires to compact. The water from the soil material drains through the porous paper into the passages in the prefabricated drain, rises to the ground surface and runs off.

A procedure of this kind is indicated when the layer which has to be dried/compacted, e.g. a clay stratum, lies on the ground surface or close thereto. Often, however, the clay bed is overlaid by coarser, readily water-conducting soil in the natural state or by earth filling, such as sand or gravel. It would not be necessary in such cases to raise the water from the clay bed all the way up to the ground surface: lifting the water into the sand layer over the clay course would be fully enough.

The same situation is also encountered when vertical draining is used to dry, to compact, a clay and mud layer on the bottom of a sea or lake and which may have a thickness of tens of meters. Vertical draining is required when the intention is to fill up e.g. a lake or sea at the point in question for the construction of a road, railway or even an air field. If the soft, compressible clay or mud layer is not vertically drained prior to the filling operation, the settling of the compressible strata under effect of the earth fill and other loads imposed on them takes many decades. The settling can be accelerated by vertical draining so that it is accomplished within a year or two, or even in a few months, depending on the subsoil conditions and the spacing of the vertical drains. Depending on the soil conditions and on the load, the settling may amount to several meters. When nowadays prefabricated drains are used towards the vertical draining of clay and mud layers, the procedure is to extend the prefabricated drains from the solid bottom through the clay course up to the water surface, where they are cut off.

The purpose of the present invention is to further develop the procedure known in the art. Thus the object of the invention is a procedure for creating a vertical drain by pushing into the soil an insertion tube housing in its interior a prefabricated drain, by pulling out the insertion tube and by cutting off the prefabricated drain. The invention is characterized in that the prefabricated drain is cut off with the aid of a cross-cutting means located within the insertion tube, at such height, or in such a layer as for instance a sand layer, which accepts the water conveyed by the prefabricated drain.

Certain remarkable advantages are gained by the aid of the invention. Since the top end of the prefabricated drain is located at a level lower than known heretofore, the hydrostatic pressure counteracting the flow in the prefabricated drain is correspondingly reduced, while at the same time the internal resistance to flow (the well resistance) in the vertical drain will be less. This accelerates the flow in the prefabricated drain and improves the operability of the drain. On the other hand this also implies that less prefabricated drain material is required, which as a rule comes in rolls. Assuming for instance that the area that has to be provided with vertical drains is 10 hectares, that the spacing of the prefabricated drains is 1.5 m and that it is possible to save 5 m of the length of each prefabricated drain, the total savings in the area will then be 220,000 meters of prefabricated drain.

The invention also concerns a means for carrying out the procedure just described. The means is characterized in that it comprises, located within the tube, a cutting blade movable in a direction transversal to the tube, and a counterblade located opposite to this first blade, and the prefabricated drain being located between these blades.

Figure 1:
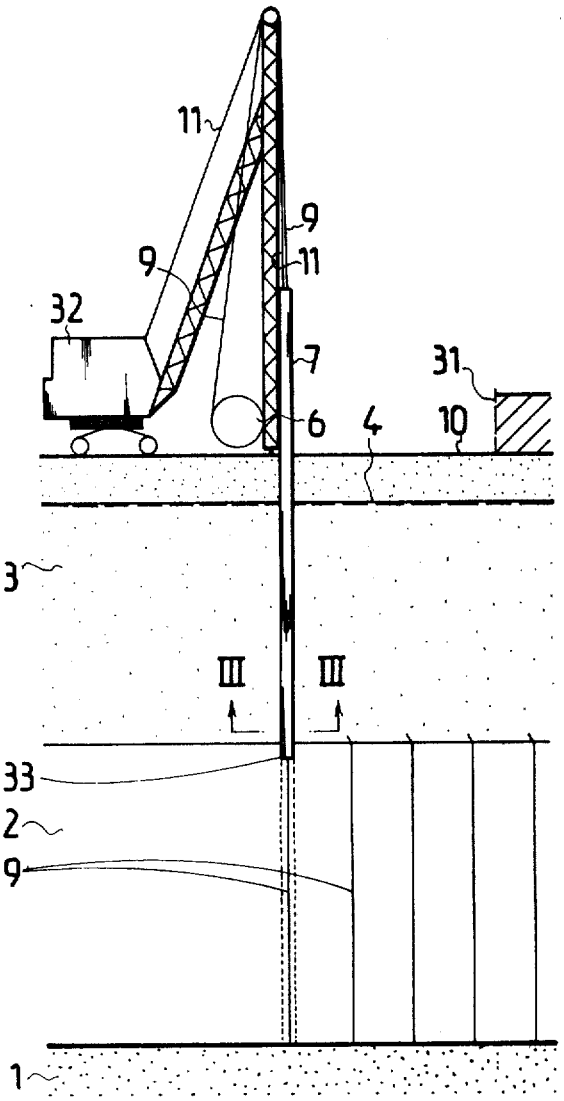
FIG. 1 illustrates the situation which is present when the prefabricated drains are inserted, from dry land, into a clay or mud layer.

FIG. 1 illustrates the case where there is, lowermost, a hard bottom 1, thereupon a clay course 2, and upon this there is water-permeable natural soil or earth filling 3, which lets water pass through. The installation of prefabricated drains 9 takes place with the aid of an insertion tube 7 mounted on a working machine 32 moving on the ground surface 10. While the insertion tube is in its top position, whereby its lower end 33 is above ground, the prefabricated drain 9 obtained from a storage coil 6 is affixed to the lower end of the insertion tube. The insertion tube 7 is then pushed through the layers 3 and 2 all the way to the hard bottom 1. The lower end of the prefabricated drain 9 is secured to the hard bottom 1 with a special anchoring device (not depicted). The insertion tube is pulled up enough to bring cross-cutting means in the tube a small distance over the top of the clay layer 2. The prefabricated drain 9 is cut off and the insertion tube raised to its top position. The working machine 32 is then slightly displaced, and another prefabricated drain 9 is introduced into the clay layer 2.

The cross-cutting means within the insertion tube 7 is located close to the lower end of the insertion tube so that it is easily accessible for servicing, repairs or replacement.

Figure 2:
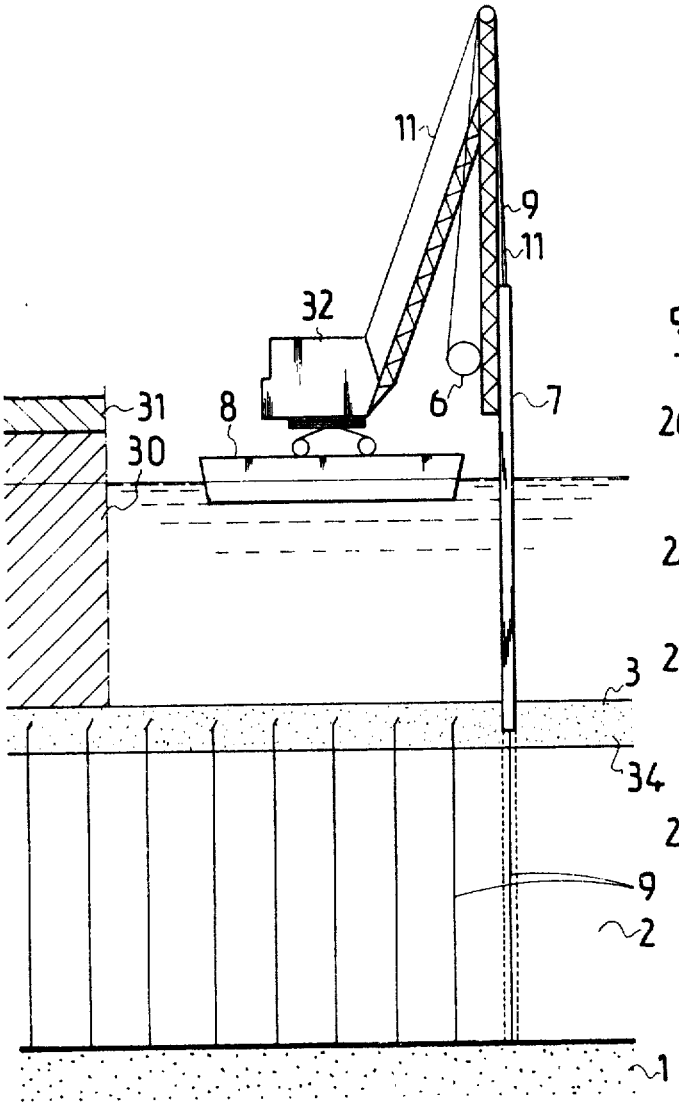
FIG. 2 illustrates a situation in which the prefabricated drains are inserted in the clay or mud layer, operating on the water surface.

FIG. 2 illustrates the case in which the prefabricated drains 9 are installed in a clay course 2 in the bottom of a water body, such as the sea for instance, with the aid of a working machine 32 floating on a pontoon 8. The operation is similar to that described in connection with FIG. 1. It is possible, before the operation is commenced, to deposit on the sea bottom a water-permeable sand course 3. After the prefabricated drains 9 have been installed, the earth filling 30 is run into the sea. It is moreover possible to cart an excess embankment 31 upon the earth filling, to speed up the settling. In the embodiment of FIG. 1 an excess embankment 31 may likewise be added.

Figure 3:
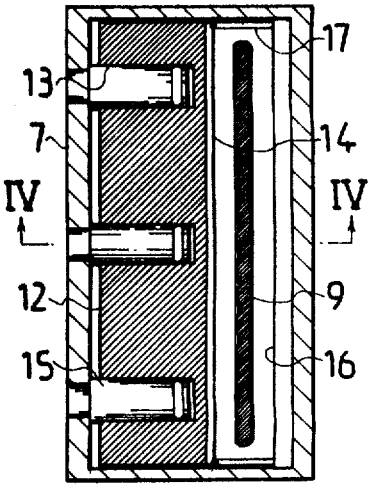
FIG. 3 shows the section along the line III—III in FIG. 1.
Figure 4:
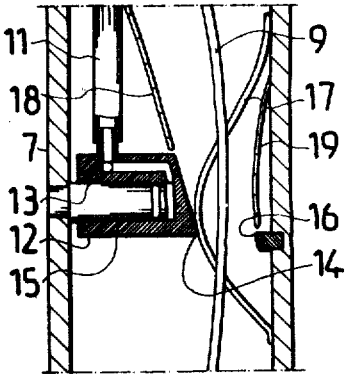
FIG. 4 shows the section along the line IV—IV in FIG. 3.

FIG. 3 shows the cross section of the insertion tube 7 at the point where the prefabricated drain cross-cutting means is located. The cross-cutting means comprises a cylinder body 12 with three cylinders 13 transversal to the insertion tube 7. The cylinder body 12 carries on its bottom a cutting blade 14, transversal to the insertion tube 7. Each cylinder 13 is guided on a stationary piston 15 affixed to the wall of the insertion tube 7. Each cylinder 13 has been connected to a pressure fluid-carrying tube 11 entering through the top end of the insertion tube 7. When pressure fluid is admitted into the cylinders, the cylinder body 12 will move to the right in FIGS. 3 and 4. Hereby it will push the prefabricated drain 9 against the counterblade 16 and cut the prefabricated drain off. Both ends of the bottom of the cylinder body 12 are acted on by a spring 17, which returns the cutting blade into its initial position as soon as the cylinders 13 are depressurized. A cutting blade protector 18 and a counterblade protector 19 protect the prefabricated drain 9 during the pulling up of the insertion tube 7.

Figure 5:
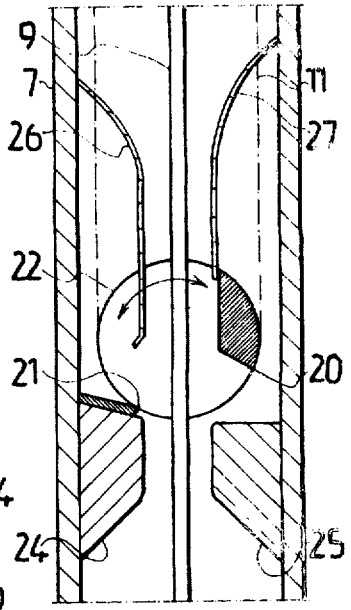
FIG. 5 is equivalent to FIG. 4 and presents another embodiment of the invention.

In the embodiment of FIG. 5, the cutting blade 20 is journalled by its ends to be carried by two opposite walls of the insertion tube 7. For cross-cutting the prefabricated drain 9, the cutting blade 20 is rotated from the position shown in FIG. 4, clockwise, through about 90 degrees, whereby it meets the counterblade 21 and cuts the prefabricated drain. The cutting blade 20 carries on its end a sprocket wheel 22 cooperating with a chain 11 entering the insertion tube 7 through its top end. The members 24, 25, 26 and 27 serve to protect the prefabricated drain 9 while the insertion tube 7 is being pulled up.

It is obvious to a person skilled in the art that different embodiments of the invention may vary within the scope of the claims stated below. This concerns, above all, the construction of the cross-cutting means within the insertion tube 7 and its mode of operation. This means may operate mechanically, hydraulically, pneumatically or electrically.

I claim:

1. A method of creating a vertical drain in a first layer of soil located below a second layer of soil, comprising: pushing into the first layer an insertion tube carrying therewithin a prefabricated drain and cross-cutting means located within said tube adjacent its lower end, securing the lower end of the drain in the soil, raising the insertion tube to a height such that said cross-cutting means is in a location in said second layer, actuating said cross-cutting means at said location to cut-off the lower end of said drain, and pulling out said insertion tube from said second layer.

2. An apparatus for installing a vertical drain in a first layer of soil located below a second layer of soil, comprising: an insertion tube for receiving therein a prefabricated drain, means for pushing said insertion tube into said first layer of soil, cross-cutting means located within said insertion tube adjacent its lower end, said cross-cutting means including a cutting blade movable transverse to the tube, and a counter blade located opposite said cutting blade.

3. An apparatus according to claim 2 comprising a cylinder arranged transverse to said insertion tube, said cutting blade being located at the lower portion of said cylinder, a stationary piston affixed to said insertion tube for guiding said cylinder, and means for introducing a pressurized fluid into said cylinder from the upper end of said insertion tube.

4. The apparatus according to claim 3, including spring means cooperating with said cylinder for returning said cutting blade to an initial position.

5. An apparatus according to claim 2, wherein said cutting blade is rotatably journalled in said tube, and sprocket wheel and chain means for rotating said blade.

* * * * *